US006701692B1

(12) United States Patent
Niehr

(10) Patent No.: US 6,701,692 B1
(45) Date of Patent: Mar. 9, 2004

(54) DEVICE FOR CLOSING PLASTIC BOTTLES

(75) Inventor: Thomas Niehr, Ahaus (DE)

(73) Assignee: GEA Finnah GmbH, Ahaus (DE)

( * ) Notice: Subject to any disclaimer, the term of this patent is extended or adjusted under 35 U.S.C. 154(b) by 0 days.

(21) Appl. No.: 09/958,542

(22) PCT Filed: May 4, 2000

(86) PCT No.: PCT/EP00/03996

§ 371 (c)(1),
(2), (4) Date: Nov. 8, 2001

(87) PCT Pub. No.: WO00/68079

PCT Pub. Date: Nov. 16, 2000

(30) Foreign Application Priority Data

May 6, 1999 (DE) ..... 299 08 075 U

(51) Int. Cl.[7] ..... B65B 55/10; B65B 55/18; B65B 7/28

(52) U.S. Cl. ..... 53/167; 53/307

(58) Field of Search ..... 53/307, 329.2, 53/167, 290, 367, 308, 306

(56) References Cited

U.S. PATENT DOCUMENTS 2,056,720 A * 10/1936 Glunz ..... 53/478
3,590,554 A * 7/1971 Carter ..... 53/69
3,712,023 A * 1/1973 Bryan et al. ..... 53/307
3,939,625 A * 2/1976 Remele et al. ..... 53/131.3
4,065,909 A * 1/1978 Mueller ..... 53/420
4,208,852 A * 6/1980 Pioch ..... 53/167
4,222,214 A * 9/1980 Schultz et al. ..... 53/309
4,936,943 A * 6/1990 Kubis et al. ..... 156/580
5,054,260 A * 10/1991 Herzog ..... 53/507
5,207,048 A * 5/1993 Wysocki ..... 53/133.2
6,199,347 B1 * 3/2001 Muller et al. ..... 53/319

FOREIGN PATENT DOCUMENTS

FR 2 653 408 * 10/1989 ..... B65B/51/12
FR 2653408 4/1991
GB 2 271 347 * 4/1994 ..... B65B/31/02

* cited by examiner

*Primary Examiner*—Rinaldi I. Rada
*Assistant Examiner*—Paul Durand
(74) *Attorney, Agent, or Firm*—Jordan and Hamburg LLP

(57) ABSTRACT

The device for sealing plastic bottles, especially PET bottles, after they are filled with a material under aseptic conditions, comprises a magazine for the seals, a delivery device for taking individual seals from the magazine and placing the seals on the filling opening of the bottles, which are fed to the treatment stations singly, consecutively and in a clocked sequence. The device further comprises a tool for carrying out the sealing operation. To this end, the delivery device takes sealing blanks, which are used as the seals, from the magazine and passes them on to the filling opening of the respectively prepared bottle, after which the sealing tool seals the sealing blank in the same working cycle onto the edge region surrounding the filling opening of the bottle, which remains in its position of readiness.

8 Claims, 3 Drawing Sheets

DEVICE FOR CLOSING PLASTIC BOTTLES

BACKGROUND OF THE INVENTION

This invention relates to a device for sealing plastic bottles, especially PET bottles.

In the case of a known device of this type (FR A 2 653 408), the delivery device, the magazine and the sealing tool operate in one and the same plane above the plane of motion of the bottles. Moreover, the placement of the sealing blank and its sealing to the prepared bottle take place while the latter remains in its position. However, this delivery process is time-consuming, because the entire process, from fetching the sealing blank to placing it on the bottle and finally sealing the latter must be completed, because fetching the next sealing blank for a subsequent delivery process can be commenced only after the sealing process has been completed.

SUMMARY OF THE INVENTION

The invention is concerned with the problem of providing a device for sealing plastic bottles, especially PET bottles, which enables the sealing plate to be supplied and sealed completely to the filling opening of a bottle within one working cycle and with an increased output.

The inventive device is designed as a compact module, which, with an advantageous short conveying distance, is placed immediately behind a filling station, and enables a sealing blank to be supplied and sealed completely to the filling opening of the bottle in a single phase. As a result of the shifting of the working plane of the delivery device towards the center plane of the bottle, which is positioned for accommodating the sealing blank, the fetching of a sealing blank and downward motion of the latter to about the height of the opening of the prepared bottle can take place independently of the sealing process, the placement operation being reduced to a short lateral motion of a support for blanks. After the placement process, the sealing of a sealing blank, which has been put in place, and the bringing along of a subsequent sealing blank can take place simultaneously, independently of one another and, so that productivity is increased as a result of the shortened cycle. If the feeding and/or sealing process is interrupted, only a single defective, filled but not yet sealed, bottle must be discarded as waste from the conveyor track, so that loss remains low.

Further details and advantageous developments arise out of the following description and the drawing, in which an example of the object of invention is illustrated in detail diagrammatically.

BRIEF DESCRIPTION OF THE DRAWINGS

FIG. 1 shows a sealing device, which is labeled 1 as a whole, for plastic bottles 2, especially are provided as PET bottles which, in a horizontal conveyor track F, by means of a conveyance (not shown in detail) in a clocked sequence, pass from an aseptic sterilizing area B into the area of a filling and gassing station 3, from which the respective plastic bottle 2 reaches the processing position 2' for a sealing process. In this area of the conveyor track F, a delivery device 6 is disposed, which is provided with a magazine 4 for the seals 5, by means of which a seal 5 is taken from the magazine 4 and, after passing through a sterilization section, which is formed by a largely closed interior space 7 of the delivery device 6, placed onto the filling opening 8 of the bottle 2'. Subsequently, the bottle 2' is sealed by means of a sealing tool 9 (FIG. 2).

DESCRIPTION OF THE PREFERRED EMBODIMENTS

Figure 1:
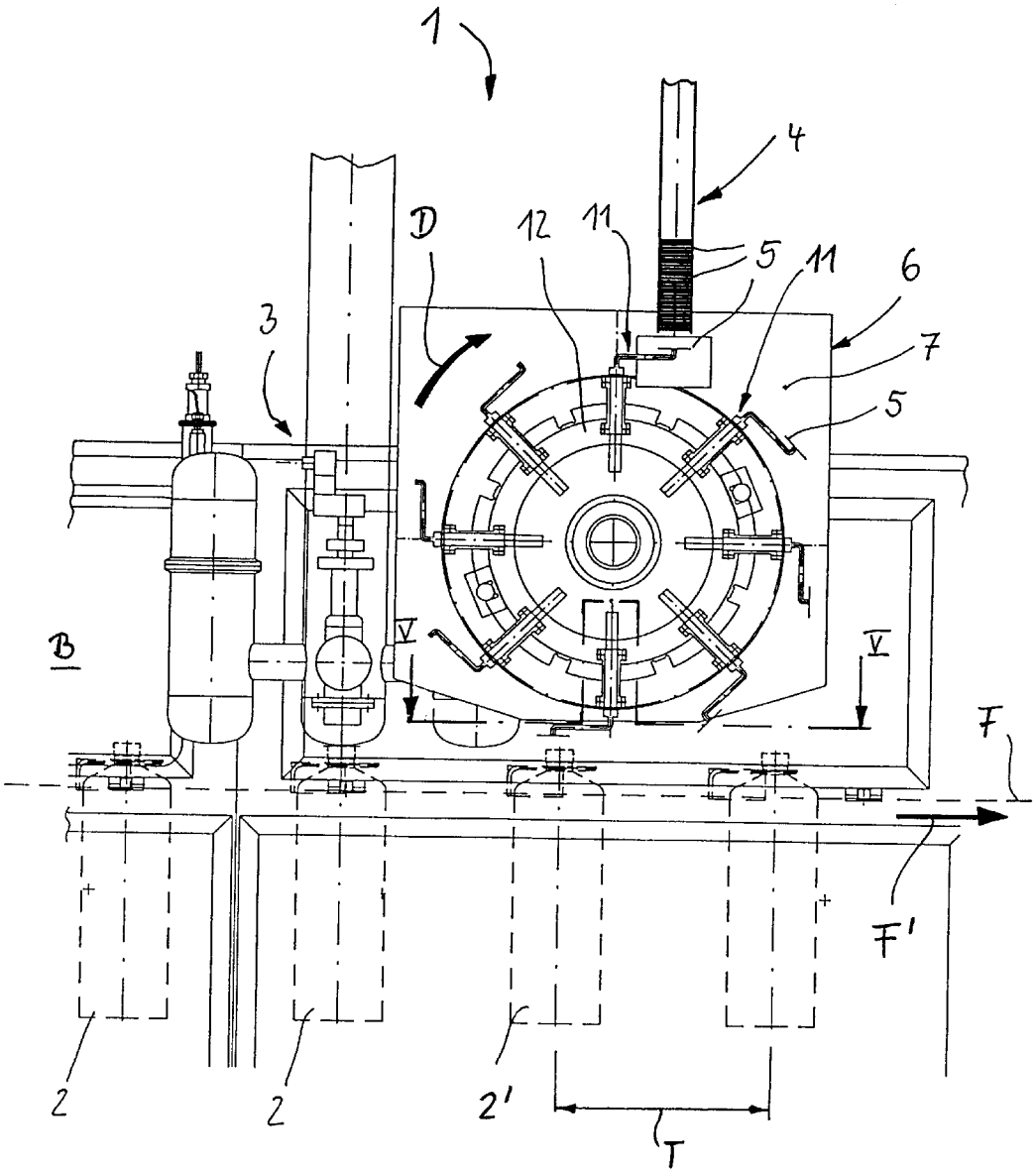
FIG. 1 shows a side view of a conveyor track of a bottling machine for plastic bottles, comprising several processing stations, FIGS. 2 to 4 each show enlarged detailed representations to illustrate different sealing phases in the sealing station.

For the inventive sealing device 1, the delivery device 6 is constructed so that the sealing blanks 5, which are taken as seals from the magazine 4, are shifted by a rotational motion D into the area of the filling opening 8 of the bottles 2' provided. Within the residence time of the bottles 2' provided until the next phase, the sealing blank 5 is placed onto the edge region around the filling opening 8 of the bottle 2', which remains in its provided position, and sealed.

The enlarged sectional representations of FIGS. 2 to 5 illustrates that the delivery device 6 has a working plane A, which is displaced laterally to the vertical, center plane M of the bottles 2, 2', parallel to the transporting direction of the bottles (arrow F') (distance C, FIG. 3), along which the bottles 2, 2' are cycled (distance T, FIG. 1). Moreover, the delivery device 6 is provided with supports 11 for the blanks which, for putting the sealing blank 5 in place, can be moved temporarily from the working plane A to the bottle 2' on the filling track F in the plane M (FIG. 1).

Figure 2:
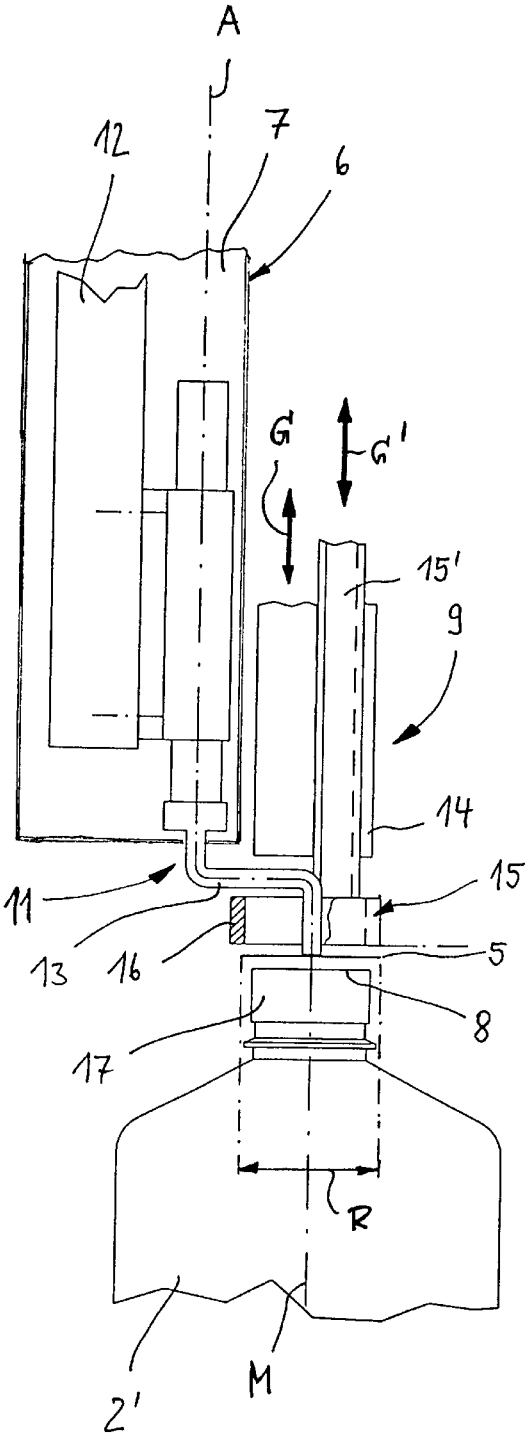

The front view of FIG. 1 shows that the delivery device 6 comprises a star wheel 12 with supports 11 for the blanks, which are distributed over the periphery and in each case are constructed as angled suction pipes 13 (FIG. 2). With their end supporting the sealing blank 5, these pipes can be shifted from the circular path (rotation D), forming the working plane A of the star wheel 12, through a horizontal swiveling motion (arrow S, FIG. 5) into the center plane M of the prepared bottles 2'. For this purpose, in each case a single swiveling driving mechanism, such as a magnetic driving mechanism (not shown), or a joint driving means, such as a curve control (not shown), can be provided. The different phases of motion of the suction pipe 13 of FIGS. 2 to 4 together with FIG. 5 show that the support 11 for the blanks is supported so that it can be rotated at the star wheel 12.

Figure 3:
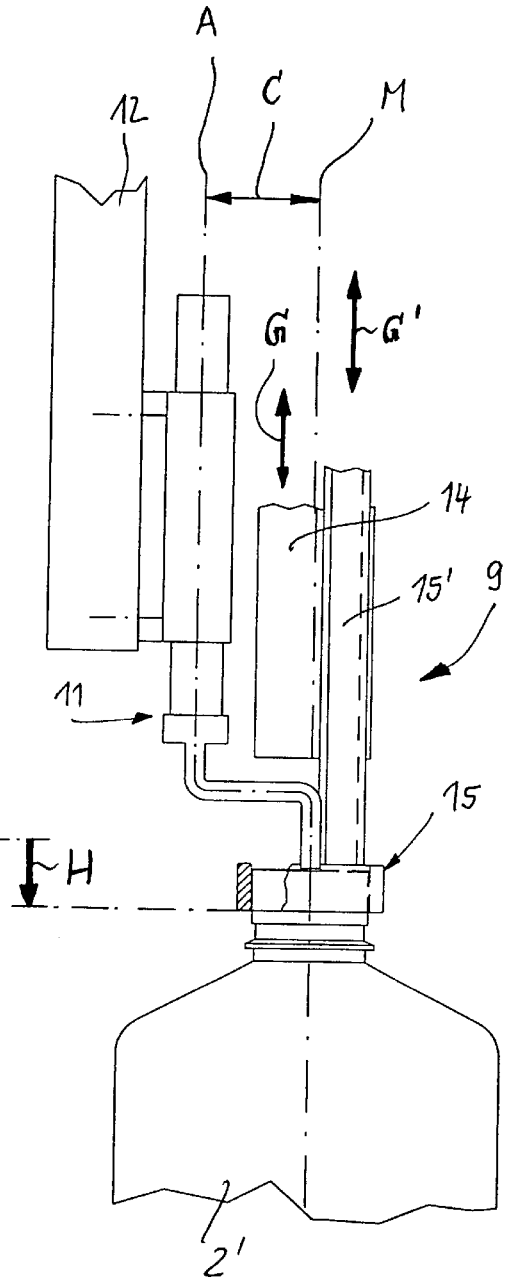

The side view of FIG. 2 shows the sealing tool 9 in the ready position above the filling opening 8. It has a sealing head 14, which can be moved vertically into and out of a sealing engagement (arrow G). At the lower end of the sealing head 14, a guiding ring 15, is provided. It projects over said head and, by means of a vertical motion (arrow G'), which is independent of the sealing head 14, engages the region of the filling opening 8 (FIG. 3). Moreover, the sealing blank 5 is moved towards the bottle 2' by the downward motion (arrow G'). During the sealing process, the sealing blank 5 is fixed by guiding ring 15 (FIG. 3), and the width of the ring (diameter of the opening) of the guiding ring 15 is dimensioned so that an unimpeded passage is provided for the sealing head 14.

The guiding ring 15 is provided with a lateral recess (not shown), which, when said support is moved into the blank delivery position for the blanks (FIG. 2), forms one in the area of the ring wall 16 for the support 11 of the blanks, when the latter is swiveled into the position shown above the filling opening 8 of the prepared bottle 2'.

Figure 4:
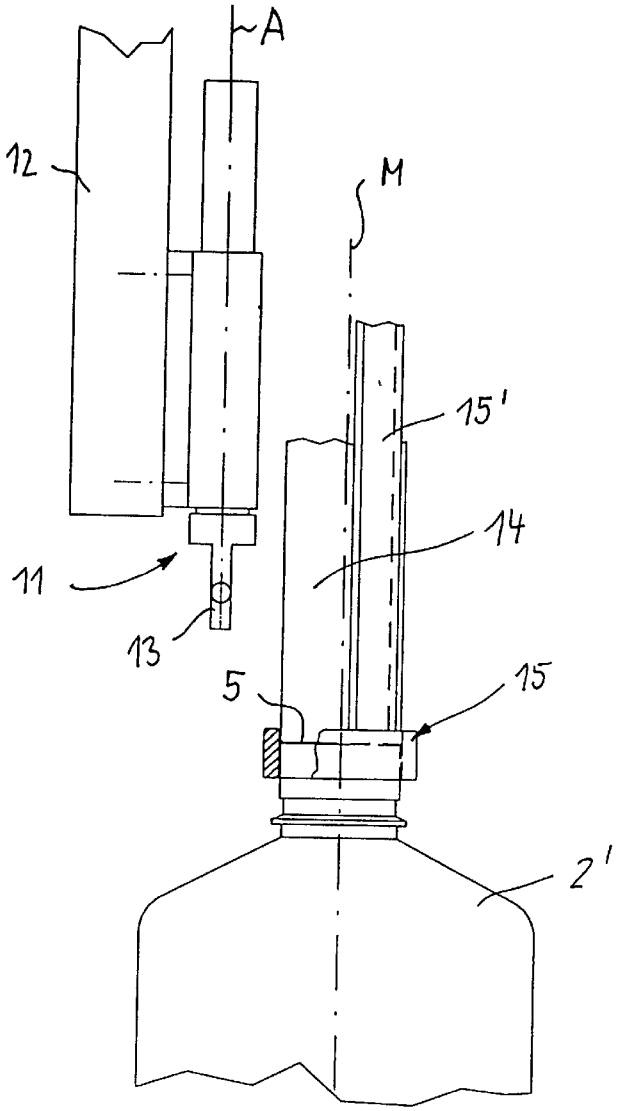
Figure 5:
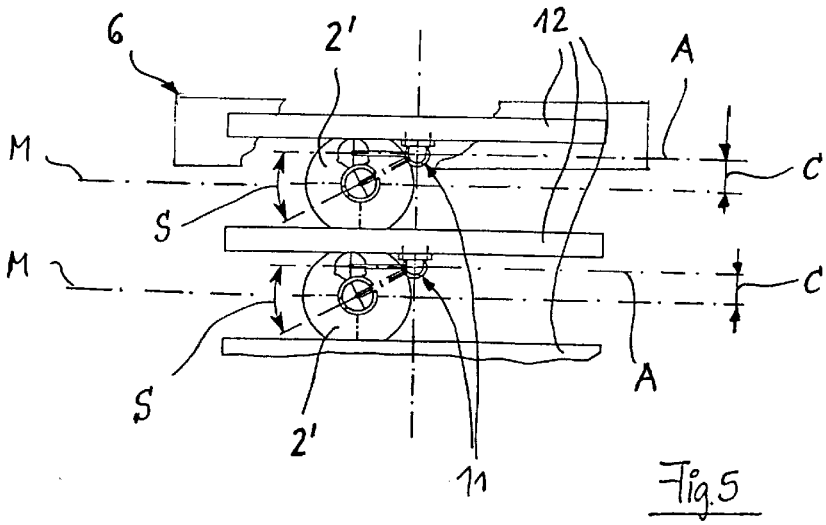
FIG. 5 shows a plan view of two parallel sealing stations along a line V—V in FIG. 1.

The phases of motion of FIGS. 2 to 4 show that the sealing head 14 of the sealing device 1 occupies a starting position above the guiding ring 15 in the starting position of the latter (FIG. 2). Even during the first sealing phase (FIG. 3), the sealing head 14 remains above the range of motion of the support 11 for the blanks, until latter is shifted over the filling opening 8 of the bottle 2' and the guiding ring 15 is shifted by means of its support 15' towards the bottle 2' (lifting path H). Moreover, the sealing blank 5 is held by the suction pipe 13 and grasped at the edge by the guiding ring 15 so that the filling opening 8 is covered positionally accurately. The diameter R of the sealing blank 5 is selected so that the filling opening 8 and, with an overlapping portion of the sealing blank 5, an edge region of the neck 17 of the bottle is overlapped.

After said placement of the sealing blank 5, the support 11 for the blank is returned to its starting position (FIG. 1) and the sealing head 14, which is constructed as a hotplate or the like, is lowered onto the sealing blank 5, so that sealing takes place in the edge region of the opening 8. Thereafter, the guiding ring 15 and the sealing head 14 together are returned to their starting position.

By means of the above-described sealing device 1, the sealing blank 5 is put in place and connected gas-tight with the plastic bottle 2 in a single cycle of the machine. The sealing blank 5 is picked from the magazine 4 in such a manner, that subsequently the side of the sealing blank 5, facing the bottle opening 8, is sterilized completely and that, during this sterilization process, there is no contact whatsoever in the interior 7 of the delivery device 6 with other contaminated surfaces of the filling station. In particular, an $H_2O_2$ aerosol is used for the sterilization. The sterilization takes place in the area of the sealing blank not taken hold of by the suction pipe 13. In Particular, the suction pipe 13 does not take hold of the center of the sealing blank 5, so that sterilization is also assured at the edge of the seal. Until the sealing blank 5 is placed on the filling opening 8 (FIG. 4), the side of the sealing blank 5 facing the product remains untouched, so that it cannot be re-contaminated.

The sealing device 1 has two subassemblies, which can be used independently of one another and consist of the delivery device 6 and the sealing tool 9. The sealing head 14 (including an appropriate heater) is spatially separated from the delivery device 6, which is provided in the region of the star wheel 12 with a sterilization device (not shown). One of these subassemblies is required for each of the conveyor track F (FIG. 5).

What is claimed is:

1. A device for sealing plastic bottles, after they have been filled with a material, comprising:

a magazine for sealing blanks, a delivery device for removing individual sealing blanks from the magazine and placing the sealing blanks on a filling opening of the bottles at a sealing position to which the bottles are conveyed individually and consecutively in a clocked sequence to treating positions, the delivery device having a housing defining a delivery device interior, and a sealing tool for sealing the sealing blanks onto an edge region which surrounds the filing opening of the bottle, while the bottle is at the sealing position and within a same working cycle as the delivery device, wherein the delivery device has a working plane displaced laterally with respect to a vertical center plane of the bottle at the sealing position within which the sealing blanks are delivered, and parallel to a transporting direction of the bottles, and the delivery device comprises supports for the sealing blanks, which, for placing down the sealing blanks, can be moved temporarily from the working plane to the bottle at the sealing position, which has been filled under aseptic conditions, and wherein the supports for the sealing blanks, after removing a sealing blank of the sealing blanks from the magazine and before placing the sealing blank on the bottle, in each case pass through a sterilization section in the delivery device interior.

2. The device of claim 1, wherein the delivery device comprises a star wheel with suction supports as the supports for the sealing blanks, on a periphery of the star wheel, the suction supports being shiftable from supporting a plurality of the sealing blanks, from the working plane of rotation of the star wheel into the center plane of the bottle at the sealing position.

3. The device of claim 2, wherein the suction supports for the sealing blanks are supported so that they can be rotated at the star wheel.

4. The device of one of the claims 1 or 2, wherein the sealing tool is disposed above the filling opening of the bottle in the sealing position and has a sealing head which is movable vertically in and out of sealing engagement with the sealing blank resting upon the filling opening of the bottle.

5. The device of claim 4, wherein the sealing tool comprises a guiding ring, movable in a vertical motion in and out of engagement with the sealing blank resting on the filling opening of the bottle, which fixes the sealing blank during the sealing operation and has a ring width which leaves a free passage for the sealing head.

6. The device of claim 5, wherein sealing head of the sealing device takes up a starting position above the guiding ring in the starting position of latter and above the region of movement of a support for the sealing blanks, when the latter is shifted over the filling opening of the bottle.

7. A device for sealing plastic bottles after they have been filled with a material, comprising:

a magazine for sealing blanks, a delivery device for removing individual sealing blanks from the magazine and placing the sealing blanks on a filling opening of the bottles at a sealing position to which the bottles are conveyed individually and consecutively in a clocked sequence to treating positions, the delivery device having a housing defining a delivery device interior;

a sealing tool for sealing the sealing blanks onto an edge region which surrounds the filing opening of the bottle, while the bottle is at the sealing position and within a same working cycle as the delivery device;

the delivery device having a working plane displaced laterally with respect to a vertical center plane of the bottle at the sealing position within which the sealing blanks are delivered, and parallel to a transporting direction of the bottles, and the delivery device comprising supports for the sealing blanks, which, for placing down the sealing blanks, can be moved temporarily from the working plane to the bottle at the sealing position, which has been filled under aseptic conditions, and wherein the supports for the sealing blanks, after removing a sealing blank of the sealing blanks from the magazine and before placing the sealing blank on the bottle, in each case pass through a sterilization section in the delivery device interior;

the sealing tool being disposed above the filling opening of the bottle in the sealing position and having a sealing head which is movable vertically in and out of sealing engagement with the sealing blank resting upon the filling opening of the bottle; and the guiding ring having a lateral recess for the passage of the support for the sealing blanks during the movement of the sealing blanks into a blank delivery position above the filling opening of the prepared bottle.

8. The device of claim 7, wherein the delivery device comprises a star wheel with suction supports as the supports for the sealing blanks on a periphery of the star wheel, the suction supports being shiftable from supporting a plurality the sealing blanks from the working plane of rotation of the star wheel into the center plane of the bottle at the sealing position.

* * * * *